United States Patent [19]

Feasel

[11] 4,109,439

[45] Aug. 29, 1978

[54] FLOOR MAT HAVING INTERCHANGEABLE DESIGN ELEMENTS

[75] Inventor: James E. Feasel, Fort Wayne, Ind.

[73] Assignee: The Airomat Corporation, Fort Wayne, Ind.

[21] Appl. No.: 808,098

[22] Filed: Jun. 20, 1977

[51] Int. Cl.[2] ..... E04C 2/42

[52] U.S. Cl. ..... 52/667; 52/105; 52/311; 15/215

[58] Field of Search ..... 52/664, 667, 669, 311, 52/105; 15/215, 216, 217; D6/225; 46/26

[56] References Cited

U.S. PATENT DOCUMENTS

| | | | |
|---|---|---|---|
| D. 161,703 | 1/1951 | Moor | 15/215 X |
| 2,225,107 | 12/1940 | Galkin | 15/216 X |
| 2,302,586 | 11/1942 | Thelen | 52/669 |
| 2,368,330 | 1/1945 | Schwartz | 52/105 |
| 3,267,628 | 8/1966 | Seery | 52/311 |
| 3,307,317 | 3/1967 | Lynn | 52/667 |

*Primary Examiner*—J. Karl Bell

*Attorney, Agent, or Firm*—Albert L. Jeffers; John F. Hoffman

[57] ABSTRACT

A floor mat of the type comprising crossed, interlocking flexible strips which are arranged in grid-like fashion. A plurality of interchangeable design elements are inserted in the rectangular interstitial spaces between the strips at various places on the mat so as to form any desired wording, design or pattern in matching or contrasting colors. The design elements, which substantially occupy the interstitial spaces, are provided with a pair of protruding lugs which interlock with suitably positioned apertures in the strips.

10 Claims, 5 Drawing Figures

FLOOR MAT HAVING INTERCHANGEABLE DESIGN ELEMENTS

BACKGROUND OF THE INVENTION

The present invention relates to floor mats and in particular to a mat comprising crossed, interlocking flexible strips which is provided with a plurality of insert elements locked in the interstitial spaces between the strips and arranged in a decorative or informational design.

In instances where floor mats are used, it is often desirable to convey information. For example, at the entrances to corporate offices, the use of the company name or symbol on the mat located at the entrance door serves to identify the building with the company and is beneficial from the standpoint of public relations and advertising. Similarly, the door mat at the entrance to a private home may be personalized with the owner's name or initials. In a more practical application, a long runner may be provided with indicia directing persons from one place to another, as in the case of public buildings which are often visited by persons who are not familiar with the locations of the various offices. In industrial installations where mats are often employed to lessen the fatigue of workers who are required to stand in front of their machines for hours at a time, the mats may be provided with indicia which identify the particular work station. Of course, the mat need not convey information but may merely be decorated so as to be esthetically pleasing.

U.S. Pat. No. 3,307,317 relates to a flexible mat which is comprised of interlocking longitudinal and transverse strips in a grid-like configuration wherein all of the strips are substantially identical in size and shape. Specifically, the strips have longitudinally spaced openings alternating with notches on their upper and lower edges and the mat is assembled by threading one set of strips through the openings of the other set such that the notches of the first set interlock therewith. In the assembled mat, each interstitial space will include a pair of aligned unused openings extending in one direction and pairs of aligned unused notches on the upper and lower edges extending in a direction perpendicular to that of the openings. As set forth in the aforementioned patent, the unused openings provide localized softer regions which render the mat more comfortable in use, the unused notches on the upper surface enhance the frictional characteristics of the mat, and the unused notches on the lower surface assist in drainage. The aforesaid U.S. Pat. No. 3,307,317 is expressly incorporated herein by reference.

SUMMARY OF THE INVENTION

The present invention is concerned with means for decorating or providing indicia on floor mats of the general type comprising intersecting longitudinal and transverse flexible strips. Generally speaking, this is accomplished by means of individual insert elements which are positioned within the interstitial spaces enclosed by the intersecting strips and arranged in the desired pattern.

Specifically, the present invention contemplates a floor mat comprising a plurality of parallel flexible first strips and a plurality of parallel flexible second strips extending transversely to and intersecting the first strips so as to form a grid having a plurality of quadrilateral interstitial spaces each bordered by an adjacent pair of the first strips and an adjacent pair of the second strips, a plurality of interchangeable insert elements disposed respectively within various of the interstitial spaces, and means associated with the insert elements and the strips bordering their respective interstitial spaces for removably locking the insert elements therein.

It is an object of the present invention to provide a floor mat having interchangeable insert elements which are locked within the interstitial spaces of the mat so that any desired pattern or design may be formed.

It is another object of the present invention to provide a floor mat having interlocking insert elements which may be changed rapidly and easily by the user with minimal effort.

A further object of the present invention is to provide a floor mat having interchangeable insert elements locked within the interstitial spaces of the mat which strengthen the mat against vertical and lateral deformation.

A further object of the present invention is to provide a floor mat having grooves on the upper and lower surfaces to improve drainage and traction.

Yet another object of the present invention is to provide a changeable design floor mat which is made of only two types of elements, each of which are uniform in size and shape so that interchangeability of parts and ease of manufacturing is achieved.

A still further object of the present invention is to provide a floor mat having interchangeable design elements which are positively locked in place and lie flush with the upper and lower surfaces of the mat.

These and other objects and features of the present invention will become more apparent from a reading of the following description, taken together with the accompanying drawing.

DESCRIPTION OF THE PREFERRED EMBODIMENT

Figure 1:
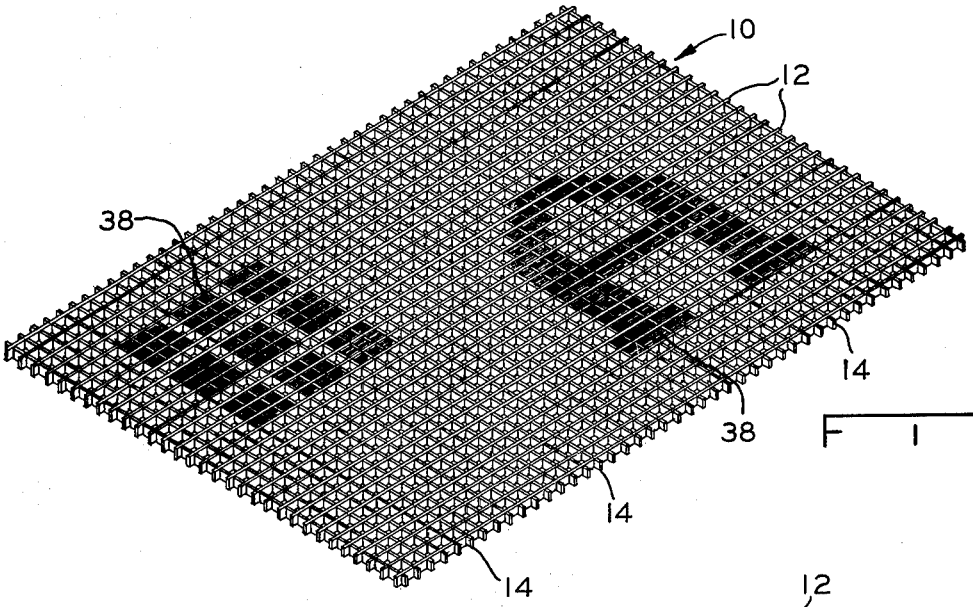
FIG. 1 is a perspective view of a floor mat according to the present invention in which a plurality of insert elements are arranged to form an arbitrary design.
Figure 2:
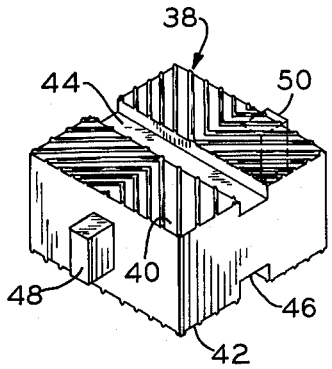
FIG. 2 is an enlarged perspective view of one of the insert elements.
Figure 3:
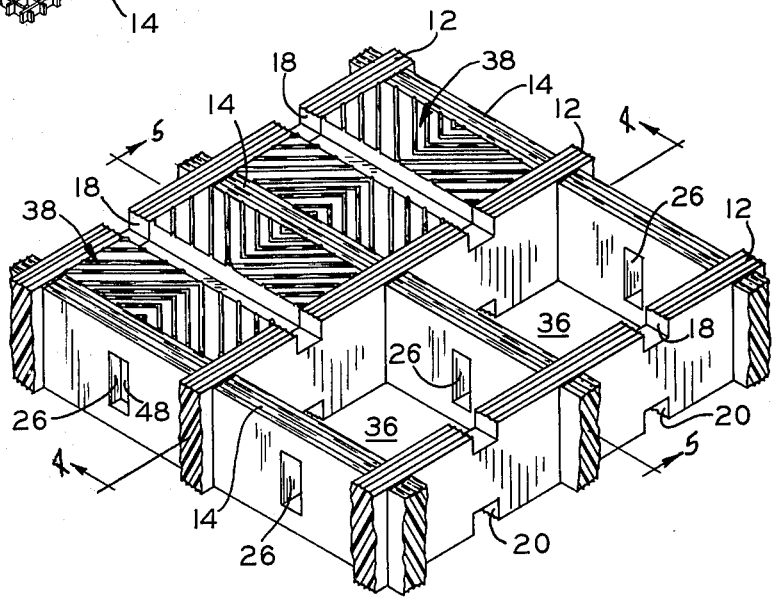
FIG. 3 is an enlarged fragmentary perspective view of a portion of the mat shown in FIG. 1.
Figure 4:
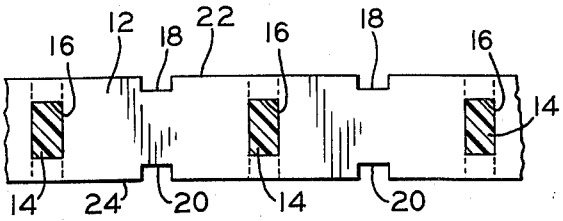
FIG. 4 is a sectional view taken along line 4—4 of FIG. 3 and viewed in the direction of the arrows.
Figure 5:
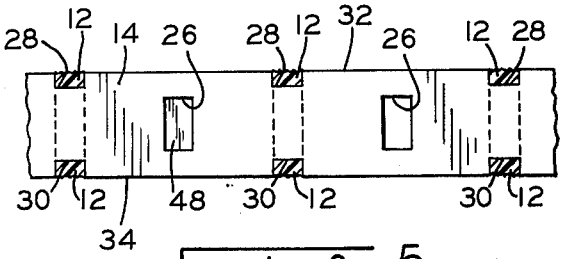
FIG. 5 is a sectional view of FIG. 3 taken along line 5—5 and viewed in the direction of the arrows.

Referring now to the drawings, the floor mat 10 according to the present invention comprises a plurality of first elongated strips 12 and a plurality of second strips 14, which extend transversely to the first set of strips 12. The strips 12 and 14 are preferably made of flexible polyvinyl chloride, but any material having similar elastic properties which permit the strips 12 and 14 to be stretched and otherwise elastically deformed will suffice.

The strips 12 and 14 are identical to each other and are preferably of rectangular cross section. Strip 12 is provided with a plurality of longitudinally spaced openings 16 alternating with notches 18 and 20 in the upper and lower edges 22 and 24, respectively. Similarly, strip 14 is provided with a plurality of longitudinally spaced openings 26 alternating with notches 28 and 30 on the upper and lower edges 32 and 34, respectively. When the mat 10 is assembled as described in the aforementioned U.S. Pat. No. 3,307,317, the notches 28 and 30 of strips 14 coincide with the openings 16 of strips 12 so as to provide an interlocked grid structure.

The upper and lower edges 22, 24 and 32, 34 of strips 12 and 14, respectively, are knurled so as to improve traction. The strips 12 and 14 may be transparent or colored depending on preference.

In a preferred form of the invention, parallel strips 12 extend perpendicularly to parallel strips 14 and the spacing is such that square interstitial openings 36 are enclosed by the strips 12 and 14. It will be noted that the notches 18 and 20 on strips 12 are aligned in successive parallel rows as are the openings 26 on strips 14.

A plurality of insert elements 38 are positioned within various of the interstitial spaces 36 formed between the intersecting strips 12 and 14 so as to form a given design. The insert elements 38 are integral blocks of flexible polyvinyl chloride, or another material having similar properties, which are congruent to the interstitial spaces 36. Each element 38 has a knurled upper surface 40, a knurled lower surface 42, a groove 44 in surface 40, a groove 46 in surface 42 and a pair of laterally extending lug portions 48 and 50. Insert elements 38 may all be of a single color or of contrasting colors, again depending on preference and the particular design which is formed. Although it is not essential that insert elements 38 be flexible, this is preferred, since it assists in their insertion and removal and preserves the resilient character of the mat 10. When in place, it will be noted that the upper and lower grooves 44 and 46 of insert members 38 are aligned with the unused notches 18 and 20 of strips 12 so as to assist in drainage of water or other liquids from the mat.

In order to insert the elements 38 in the desired interstitial spaces 36, adjacent strips 14 are bowed outwardly and the lugs 48 and 50 snapped into their respective openings 26. The inherent resiliency of strips 14 will retain lugs 48 and 50 and apertures 26 engaged so that the insert elements 38 are positively locked in place. Although openings 26 preferably extend completely through strips 14, they may take the form of recesses sufficiently deep to accommodate the lugs 48 and 50, if desired. From a manufacturing standpoint, however, an opening extending completely through the strip 14 is preferred.

By arranging insert elements 38 in selected interstitial spaces 36, a wide variety of patterns, designs, words or numerals may be formed in the mat 10. The elements 38 are extremely easy to remove and replace so that changes in design may be effected by the user without the necessity for returning the mat 10 to the manufacturer. Although the overall resiliency of the mat is retained, elements 38 tend to reinforce the mat against lateral and vertical deformation. Depending on the location and spacing of the element 38, the entire mat 10 or localized portions thereof may be reinforced for heavier load conditions.

In an exemplary embodiment of the invention, strips 12 and 14 are $\frac{1}{4}$ inch wide and $\frac{1}{2}$ inch high and the spacing between adjacent strips is $\frac{7}{8}$ inch. The insert elements 38 are correspondingly dimensioned.

While there have been described above the principals of this invention in connection with specific apparatus, it is to be clearly understood that this invention is only made by way of example and not as a limitation to the scope of the invention.

What is claimed is:

1. A mat comprising:

a plurality of parallel flexible first strips and a plurality of parallel flexible second strips extending transversely to and intersecting said first strips so as to form a grid of readily deformable grid squares each comprising a quadrilateral interstitial space bordered by an adjacent pair of said first strips and an adjacent pair of said second strips, a plurality of interchangeable insert element means disposed respectively within various of said interstitial spaces, and means associated with said insert element means and the strips bordering their respective said interstitial spaces for removably locking said insert element means in their respective said spaces.

2. The mat of claim 1 wherein said insert element means are substantially congruent respectively to the interstitial spaces in which they are disposed.

3. The mat of claim 2 wherein:

said first strips each have a plurality of longitudinally spaced openings therethrough, said openings of each of said first strips being aligned with the openings of the other of said first strips so as to form a plurality of parallel rows of said openings which extend transversely to said first strips, said second strips extend respectively through said rows of aligned openings and are locked therein.

4. The mat of claim 3 wherein said first and second strips have upper and lower edges which lie respectively in parallel planes, and said insert element means are substantially flush with said upper and lower edges.

5. The mat of claim 4 wherein said first strips include notches on their upper edges, and said insert element means include upper surfaces flush with said strip upper edges and grooves thereon in alignment with the notches on adjacent said first strips.

6. The mat of claim 1 wherein said locking means comprise interfitting lugs and openings on said insert element means and strips, respectively.

7. A mat comprising:

a series of parallel elongated flexible first strips, each of said strips having a plurality of longitudinally spaced openings, said openings of each of said strips being aligned with openings of the other said strips so as to form a plurality of parallel rows of openings which extend perpendicularly to said first strips, a series of elongated flexible second strips extending respectively through said rows of aligned openings and being locked therein so as to form an orthogonal grid of readily deformable grid squares each comprising a quadrilateral interstitial space enclosed by an adjacent pair of said first strips and an adjacent pair of said second strips, a plurality of rectangular, interchangeable insert element means disposed respectively within various of said interstitial spaces, said insert element means being substantially congruent to the spaces in which they are disposed, and means associated with each insert element means and its respective said interstitial space for removably locking said insert element means in place comprising lugs on two sides of said insert element means which are slidably insertable in cooperating second openings in two of the strips bordering said interstitial space along directions normal to their respective said insert element sides.

8. The mat of claim 7 wherein said second strips are identical to said first strips.

9. The mat of claim 7 wherein:

said second openings are longitudinally spaced along said second strips, and the second openings of one of said second strips are aligned with the second openings of the other of said second strips, said second strips include a plurality of second notches alternating with said second openings and positioned respectively within said first openings, said first strips include a plurality of first notches alternating with said first openings, said first notches of each of said first strips are aligned with the notches of the other of said first strips so as to form a plurality of parallel rows of said first notches extending perpendicularly to said first strips, said insert members have grooves thereon aligned respectively with said rows of first notches.

10. The mat of claim 7 wherein said strips and said insert element means have knurled upper surfaces.

* * * * *